United States Patent [19]

Workman, Jr.

[11] 4,346,765

[45] Aug. 31, 1982

[54] SPEED RESPONSIVE MOTOR SHUTOFF MECHANISM FOR FLUID OPERATED TOOL

[75] Inventor: William Workman, Jr., Spring Lake, Mich.

[73] Assignee: Cooper Industries, Inc., Houston, Tex.

[21] Appl. No.: 152,892

[22] Filed: May 23, 1980

Related U.S. Application Data

[63] Continuation-in-part of Ser. No. 13,486, Feb. 21, 1979, abandoned.

[51] Int. Cl.[3] ..... B25B 23/145

[52] U.S. Cl. ..... 173/12; 81/470; 415/25

[58] Field of Search ..... 173/12; 91/59; 415/25; 425/36; 192/54, 150; 418/40, 41, 42, 43, 44; 81/470

[56] References Cited

U.S. PATENT DOCUMENTS

| | | | |
|---|---|---|---|
| Re. 27,550 | 1/1973 | Bangerter | 91/59 X |
| 3,520,392 | 7/1970 | Deremo et al. | 192/150 |
| 3,739,659 | 6/1973 | Workman, Jr. | 81/470 X |
| 3,785,442 | 1/1974 | Amtsberg et al. | 173/12 |
| 3,791,458 | 2/1974 | Wallace | 173/12 |
| 3,850,553 | 11/1974 | Wallace | 418/43 |
| 3,904,305 | 9/1975 | Boyd | 173/12 X |
| 4,004,859 | 1/1977 | Borries | 173/12 X |
| 4,019,589 | 4/1977 | Wallace | 173/12 |
| 4,120,604 | 10/1978 | Garofalo | 415/25 |

*Primary Examiner*—Robert Mackey

*Attorney, Agent, or Firm*—Michael D. McCully; Eddie E. Scott; Michael E. Martin

[57] ABSTRACT

A portable pneumatic tool includes a valve closure member interposed in the tool motor exhaust passage and engaged with a speed responsive mechanism comprising a plurality of flyweights operable to move the closure member to an open position on starting of the tool motor. On decreasing motor speed a coil spring assisted by a fluid pressure drop across the closure member forces the closure member to move against the decreasing centrifugal force exerted by the flyweights to shut off motor exhaust fluid flow to stop the motor. The closure member is normally held in a partially open position by a second spring to enable the motor to be started. An alternate embodiment includes a limited motion coupling between the valve closure member and the motor drive shaft which provides assistance in opening and closing the valve closure member.

8 Claims, 5 Drawing Figures

SPEED RESPONSIVE MOTOR SHUTOFF MECHANISM FOR FLUID OPERATED TOOL

This is a continuation-in-part of U.S. patent application Ser. No. 013,486 filed Feb. 21, 1979, abandoned.

BACKGROUND OF THE INVENTION

This invention pertains to a speed responsive shutoff mechanism for a pneumatic nut running tool wherein the motor exhaust flow is interrupted at a predetermined minimum speed of the tool motor as the motor approaches the stall condition.

In the art of control devices for pneumatic power tools, in particular nutsetters, screwdrivers and the like, there have been a number of inventions dealing with a speed responsive valve for shutting off the motor inlet air flow when the motor speed approaches the stall condition. U.S. Pat. Nos. 3,904,305; 4,004,859 and 4,120,604 disclose pneumatic tools which include speed responsive valve mechanisms for shutting off fluid flow to the motor inlet port when the motor approaches the stall condition from a relatively high speed operating condition. U.S. Pat. Nos. 3,785,442; 3,791,458 and 3,850,553 disclose speed responsive devices which generate a pressure fluid signal at a predetermined minimum speed of the tool motor to cause a servo-operated valve to shut off motive fluid flow.

A common disadvantage of the devices disclosed in the first three patents abovementioned is that although the speed responsive devices operate to shut off directly the fluid flow to the motor inlet port, these devices all require a so-called bypass valve for providing motive air to start the motor so that the respective centrifugal force responsive mechanisms can open a motor inlet fluid passage which is then reclosed on decreasing motor speed.

The three last mentioned patents also disclose somewhat complicated mechanisms which require speed responsive valve devices that provide a pressure fluid signal for operating separate motive fluid shutoff valves.

SUMMARY OF THE INVENTION

The present invention provides for a speed responsive motive fluid shutoff device for a fluid operated tool such as a pneumatic nutsetter or the like which operates to shut off the motive fluid exhaust flow from the tool motor in response to decreasing motor speed. Accordingly, the shutoff device according to the present invention may be used to control the maximum torque exerted by the tool on a driven fastener. The motor shutoff mechanism of the present invention also functions to indicate that the tool motor speed has decreased to a predetermined minimum on approaching a stalled condition. Moreover, the motor shutoff mechanism in accordance with the present invention is designed to minimize the torque reaction imposed on the tool operator as the tool motor approaches the stalled high output torque condition.

The speed responsive motor exhaust flow shutoff valve is particularly advantageous in that a disc or plate type valve closure member is arranged in the motor exhaust fluid flow path and is actuated substantially directly by a speed responsive flyweight mechanism. Moreover, the motor exhaust flow shutoff valve does not require a bypass valve for providing motive fluid to start the tool motor as with prior art mechanisms.

Accordingly, the speed responsive motor shutoff mechanism of the present invention is compact, mechanically simple, less complicated, and less expensive than heretofore known speed responsive motor shutoff devices for fluid operated tools.

DESCRIPTION OF THE PREFERRED EMBODIMENTS

Figure 1:
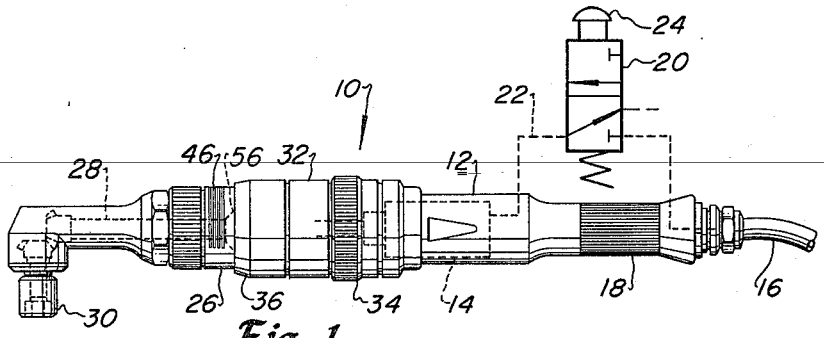
FIG. 1 is a longitudinal side elevation of a portable pneumatic tool which includes the speed responsive motor shutoff mechanism of the present invention.

Referring to FIG. 1 of the drawing, the speed responsive motor shutoff mechanism of the present invention is adapted to be used in a portable pneumatic tool generally designated by the numeral 10 and comprising a nutsetter. The tool 10 includes a housing portion 12 in which is disposed a conventional rotary vane type expansible chamber motor 14. Motive fluid such as compressed air is supplied to the tool by way of a flexible conduit 16 connected to the tool handle 18. A manually actuated shutoff valve 20, shown schematically in FIG. 1, is operable to control the supply of pressure fluid to the motor by way of passage 22. The valve 20 is shown schematically in FIG. 1 for clarity and is adapted to be disposed in the tool housing and to be actuated by a suitable operating lever 24. The tool 10 also includes a housing portion 26 which includes a drive shaft 28 suitably connected to a socket member 30 for driving a threaded fastener or the like in a known way.

Figure 2:
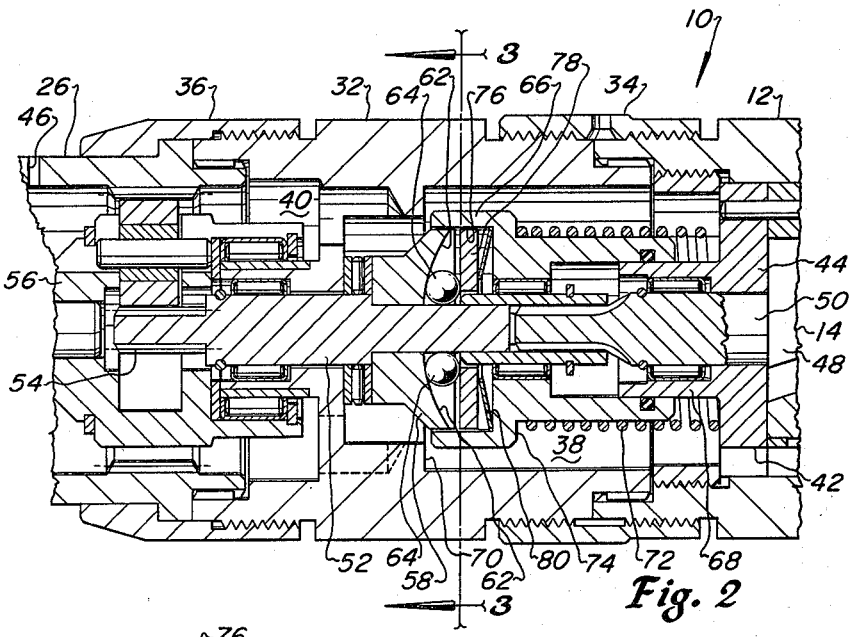
FIG. 2 is a longitudinal center section of the speed responsive motor shutoff mechanism embodied in the tool shown in FIG. 1; and, FIG. 3 is a section view taken along the line 3—3 of FIG. 2.

The tool 10 further includes a housing portion 32 intermediate the housing portions 12 and 26 and suitably secured thereto by respective threaded collars 34 and 36. Referring to FIG. 2, the housing portion 32 is adapted to have interior chambers 38 and 40 which may be in fluid conducting communication with each other to form passage means for the exhaust fluid flow from the motor 14. Exhaust fluid from the motor 14 is conducted to the chamber 38 through motor exhaust port means 42 in the motor end plate 44. Exhaust fluid flows from the chamber 40 through the hollow interior of the housing portion 26 and exits from the tool through suitable louvers 46, shown in FIG. 1.

Referring again to FIG. 2, the motor 14 includes a rotor 48 having an output shaft portion 50 which is drivably coupled to an intermediate drive shaft 52. The drive shaft 52 is rotatably supported in the housing portion 32 and includes a portion forming the sun gear 54 of a planetary gear drive. The planetary gear drive includes a planet gear carrier 56 which is drivably connected to the final drive shaft 28. The speed responsive motor shutoff mechanism of the present invention includes a member 58 disposed on the drive shaft 52 for rotation therewith. The member 58 includes a plurality of generally radially extending grooves 60 formed therein, see FIG. 3 also. The grooves 60 are formed to have inclined bottom surfaces 62 and the grooves each contain a movable flyweight or spherical ball 64 which is movable along the groove radially outwardly with respect to the drive shaft 52 in response to centrifugal force. The speed responsive motor shutoff mechanism further includes an axially movable member 66 forming a valve closure member for interrupting the flow of exhaust fluid from the chamber 38 to the chamber 40. The closure member 66 is axially slidably supported by a hub portion 68 of the motor end plate 44 and by the intermediate drive shaft 52. The closure member 66 is operable to engage a seat 70 formed by a transverse wall surface facing the interior chamber 38. The closure member 66 is biased toward the seat 70 by a coil spring 72 disposed between a flange 74 on the closure member and the motor end plate 44.

The closure member 66 includes a recess 76 opening to one end thereof in which the member 58 is partially disposed. An annular plate 78 is also disposed in the recess 76 and is engageable with the balls 64 even when they are disposed in their radially innermost positions in the grooves 60. A circular disc spring washer 80 is disposed between the plate 78 and the bottom of the recess 76. The stiffness of the spring washer 80 is greater than the stiffness of the spring 72 and the spring washer exerts a biasing force in opposition to the spring 72. Accordingly, when the fluid pressure in the chambers 38 and 40 is essentially the same the spring washer 80 holds the closure member 66 a short distance away from the seat 70 as shown in FIG. 2. Accordingly, when pressure fluid is introduced to the motor 14 on startup some exhaust fluid flow is allowed to pass through the chambers 38 and 40 to enable the motor to start. Once the motor 14 has commenced to rotate the shaft 52 rapidly, the balls 64 are forced radially outwardly in the grooves 60 and due to the inclined bottom surfaces 62 the balls force the plate 78 and the closure member 66 to the right, viewing FIG. 2, to increase the size of the passageway formed between the closure member and the seat 70. Therefore, when the motor 14 is operating at greater than idle speed or greater than approximately ten percent of its free speed, the exhaust flow is not impeded.

In normal operation of the tool 10 for running down and tightening a threaded fastener, when the motor 14 is at rest and the valve 20 is closed, the closure member 66 is in the position shown in FIG. 2. When the valve 20 is moved to the position to conduct pressure fluid through the passage 22 to the motor 14, the initial flow of motive fluid permitted by the small opening between the closure member 66 and the seat 70 is sufficient to allow the motor to accelerate enough to cause the balls 64 to force the closure member to the fully open position. The closure member 66 will remain in a substantially full open position with the spring 72 compressed until rotative speed of the motor 14 and the drive shaft 52 decreases to approximately ten percent of the motor free or unloaded speed. This reduced speed is normally commensurate with the desired maximum torque to be delivered by the motor to the fastener being tightened. As the motor speed decreases to the condition mentioned above, the bias of the spring 72 will force the balls 64 radially inward in the grooves 60 overcoming the reduced centrifugal forces acting on the balls and the closure member will move toward the seat 70. As the passageway formed between the closure member 66 and the seat becomes more restricted with movement of the closure member, the exhaust fluid pressure in the chamber 38 increases in relation to the pressure in chamber 40 and a pressure force acting on the flange 74 will cause the closure member to move rapidly into engagement with the seat overcoming the bias force of the spring washer 80. When the exhaust flow is shut off entirely the motor 14 will stop and the fluid pressure difference across the motor will quickly diminish to reduce substantially the motor output torque whether or not the valve 20 remains open or closed.

When the valve 20 is released by the tool operator the fluid pressure in the motor 14 as well as the exhaust chamber 38 will be reduced due to leakage flow and venting through the valve 20 in the closed position. When the fluid pressure in the chamber 38 decreases sufficiently, the spring washer 80 will move the closure member 66 away from the seat 70 to the position shown in FIG. 2 and the shutoff mechanism will be ready for another operating cycle of the tool 10.

Figure 4:
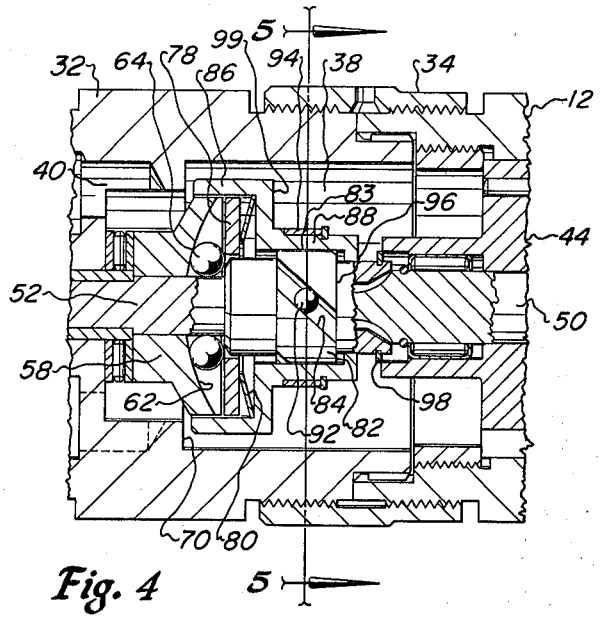
FIG. 4 is a longitudinal center section view of an alternate embodiment of the present invention.
Figure 5:
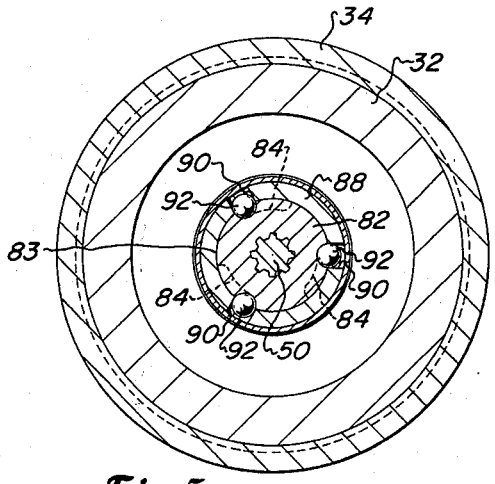
FIG. 5 is a section view taken along the line 5—5 of FIG. 4.

An alternate embodiment of the present invention is shown in FIGS. 4 and 5. Referring to FIG. 4, the motor rotor output shaft portion 50 is drivably connected to a coupling member 82 having cylindrical journal 83 and a plurality of spiral grooves 84 formed on the periphery thereof, as shown also in FIG. 5. The coupling member 82 is drivably connected to the shaft 52. A closure member 86 similar to the closure member 66 is mounted on the coupling member 82 and includes a hub portion 88 having spaced apart holes 90 in which are disposed ball keys 92. The ball keys 92 extend into the grooves 84 to form a driving connection between the coupling member 82 and the closure member. The ball keys 92 are retained in engagement with the closure member 86 and the coupling member 82 by a spring band 94. Accordingly, the closure member 86 is operable to move axially on the coupling member 82 between a shoulder 96 on the coupling member and a retaining ring 98 also disposed on the coupling member. In moving axially the closure member 86 also undergoes some rotation with respect to the coupling member because of the coupling formed by the ball keys 92 and the spiral grooves 84.

Figure 3:
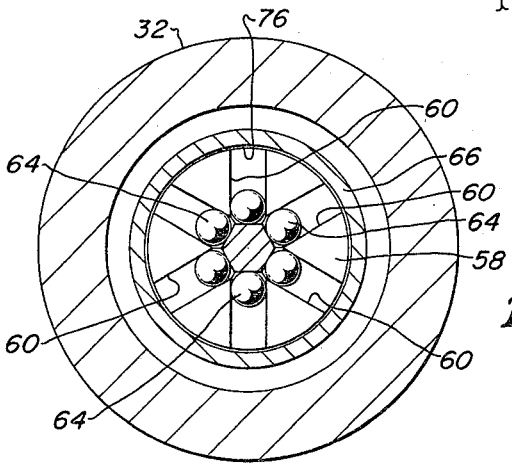

The shutoff mechanism shown in FIGS. 4 and 5 operates in a manner similar to the mechanism shown in FIGS. 1 through 3, that is, when the motor 14 is at rest and the valve 20 is closed the closure member 86 normally assumes the position shown in FIG. 4. However, because of the limited motion coupling formed between the member 82, and the closure member 86 the closure member may be in a further open position. Accordingly, when the valve 20 is opened the motor 14 will accelerate the balls 64 to force the closure member 86 to the fully open position if in fact it is not already in that position. The coupling formed between the closure member 86 and the coupling member 82 will also assist in moving the closure member toward the open position due to the inertia of the closure member.

When motor speed decreases due to increased torque and the balls 64 move radially inwardly in the grooves 60 the angular momentum of the rotating closure member 86 will urge it to move with respect to the coupling member 82 rotatably and axially toward the valve seat 70. As the closure member 86 approaches the seat 70 the reduced flow area formed between the seat and the closure member will create a pressure differential acting on the flange 99 of the closure member causing the same to move rapidly toward the closed position whereby the motor 14 will stop. As in the embodiment of FIGS. 1 thru 3, the valve closure member 86 will remain closed as long as the valve 20 is held open and a pressure differential exists across the flange 99 of the closure member. When the pressure in the chamber 38 is reduced upon closure of the valve 20, the spring washer 80 will move the closure member 86 to the partially open position shown in FIG. 4 so that another operating cycle may be commenced upon opening of the valve 20.

What I claim is:

1. In a fluid operated tool for tightening threaded fasteners and the like:

a housing;

a fluid operated motor including a rotary output shaft disposed in said housing;

a fluid supply passage in said housing for conducting pressure fluid to said motor;

means forming a fluid exhaust passage in said housing for conducting exhaust fluid away from said motor to the exterior of said housing;

a valve closure member interposed in said exhaust passage and movable between an open position permitting exhaust fluid flow through said exhaust passage and a closed position blocking the flow of exhaust fluid through said exhaust passage to effect the stopping of said motor;

means responsive to decreasing motor speed to cause said closure member to move to said closed position, said means comprising a rotatable member drivably engaged with said output shaft and flyweights engaged with said rotatable member and responsive to starting of said motor to move said closure member to said open position to permit the flow of exhaust fluid through said exhaust passage;

a limited motion coupling drivably interconnecting said motor and said closure member, said coupling including a coupling member drivably connected to said output shaft and to said closure member and operable in response to increasing motor speed to permit said flyweights to move said closure member to said open position, said coupling member including a journal portion, said closure member being disposed on said journal portion, and means forming a driving connection between said coupling member and said closure member which provides for limited axial and rotational movement of said closure member with respect to said coupling member to urge said closure member to move toward a closed position in response to a decreasing centrifugal force on said flyweights caused by the speed of said motor output shaft decreasing below a predetermined minimum.

2. The invention set forth in claim 1 wherein:

said means forming a driving connection between said coupling member and said closure member includes spiral groove means on one of said closure member and said coupling member and key means engaged with the other of said closure member and said coupling member and extending into said groove means.

3. The invention set forth in claim 2 together with:

spring means for biasing said closure member to a partially open position to permit an initial flow of exhaust fluid from said motor upon starting said motor.

4. The invention set forth in claim 3 together with:

a motive fluid shutoff valve interposed in said fluid supply passage leading to said motor, said motive fluid shutoff valve being operable in its motive fluid shutoff position to vent pressure fluid from said motor and said exhaust passage between said motor and said closure member.

5. The invention set forth in claim 3 wherein:

said rotatable member includes a plurality of substantially radially extending grooves, said grooves having respective inclined bottom surfaces, and said flyweights comprise a plurality of spherical balls disposed one in each of said respective grooves and operable in response to centrifugal forces acting thereon to move radially outwardly in said grooves to cause said closure member to move to a fully open position.

6. The invention set forth in claim 5 wherein:

said means responsive to decreasing motor speed includes a plate interposed between said closure member and said balls and engageable with said balls, and said spring means includes a spring washer interposed between and engaged with said plate and said closure member.

7. In a fluid operated tool for tightening threaded fasteners and the like:

a housing;

a fluid operated motor including a rotary output shaft disposed in said housing;

a fluid supply passage in said housing for conducting pressure fluid to said motor;

means forming a fluid exhaust passage in said housing for conducting exhaust fluid away from said motor to the exterior of said housing;

a valve closure member interposed in said exhaust passage and movable between an open position permitting exhaust fluid flow through said exhaust passage and a closed position blocking the flow of exhaust fluid through said exhaust passage to effect the stopping of said motor;

means responsive to decreasing motor speed to cause said closure member to move to said closed position, said means comprising a rotatable member drivably engaged with said output shaft, and flyweights engaged with said rotatable member and responsive to starting of said motor to move said closure member to an open position to permit the flow of exhaust fluid through said exhaust passage;

a limited motion coupling drivably interconnecting said motor and said closure member, said coupling including a coupling member drivably connected to said output shaft and to said closure member and operable in response to increasing motor speed to permit said flyweights to move said closure member to said open position, and means forming a driving connection between said coupling member and said closure member which provides for limited axial and rotational movement of said closure member with respect to said coupling member to urge said closure member to move toward a closed position upon decreasing centrifugal force acting on said flyweights caused by the speed of said motor output shaft decreasing below a predetermined minimum.

8. In a fluid operated tool for tightening threaded fasteners and the like:

a housing;

a fluid operated motor including a rotary output shaft disposed in said housing;

a fluid supply passage in said housing for conducting pressure fluid to said motor;

means forming a fluid exhaust passage in said housing for conducting exhaust fluid away from said motor to the exterior of said housing;

a valve closure member interposed in said exhaust passage and movable between an open position permitting exhaust fluid flow through said exhaust passage and a closed position blocking the flow of exhaust fluid through said exhaust passage to effect the stopping of said motor;

means responsive to starting of said motor to move said closure member to an open position to permit the flow of exhaust fluid through said exhaust passage, said means being responsive to decreasing motor speed to allow said closure member to move toward said closed position; and a limited motion coupling drivably interconnecting said motor and said closure member;

said coupling including a coupling member drivably connected to said output shaft and to said closure member and operable to permit said motor responsive means to move said closure member to said open position in response to increasing speed of said output shaft, and means forming a driving connection between said coupling member and said closure member which provides for limited axial and rotational movement of said closure member with respect to said coupling member to urge said closure member to move toward a closed position in response to decreasing speed of said output shaft.

* * * * *